US008808017B2

(12) United States Patent
York et al.

(10) Patent No.: US 8,808,017 B2
(45) Date of Patent: Aug. 19, 2014

(54) ELECTRICAL CONNECTOR WITH ANTI-ARCING FEATURE

(71) Applicant: Anderson Power Products, Inc., Sterling, MA (US)

(72) Inventors: Charles L York, Townsend, MA (US); Brian F Davies, Acton, MA (US)

(73) Assignee: Anderson Power Products, Inc., Sterling, MA (US)

( * ) Notice: Subject to any disclaimer, the term of this patent is extended or adjusted under 35 U.S.C. 154(b) by 111 days.

(21) Appl. No.: 13/734,025

(22) Filed: Jan. 4, 2013

(65) Prior Publication Data

US 2014/0193991 A1 Jul. 10, 2014

(51) Int. Cl.
*H01R 13/53* (2006.01)

(52) U.S. Cl.
CPC ..... *H01R 13/53* (2013.01)
USPC ..... 439/183

(58) Field of Classification Search
CPC ..... H01R 13/53; H01R 31/02; H01H 33/045; H02G 15/103; H02G 15/12
USPC ..... 439/183, 187, 181
See application file for complete search history.

(56) References Cited

U.S. PATENT DOCUMENTS 3,474,386 A * 10/1969 Link ..... 439/181
3,534,322 A * 10/1970 Hoffa ..... 439/274
3,539,972 A * 11/1970 Silva et al. ..... 439/185
3,542,986 A * 11/1970 Kotski ..... 218/90
3,586,802 A * 6/1971 Nichols et al. ..... 218/90
3,720,904 A * 3/1973 De Sio ..... 439/131
3,747,048 A * 7/1973 Johnson et al. ..... 439/276
3,835,439 A * 9/1974 Yonkers ..... 439/187
3,945,699 A * 3/1976 Westrom ..... 439/38
3,949,343 A * 4/1976 Yonkers ..... 337/192
3,957,332 A * 5/1976 Lambert, III ..... 439/38
4,113,339 A * 9/1978 Eley ..... 439/183
4,131,329 A * 12/1978 Flatt ..... 439/185
4,192,572 A * 3/1980 Stanger et al. ..... 439/185

(Continued)

FOREIGN PATENT DOCUMENTS

KR 19980080901 A 11/1998
KR 20010078101 A 8/2001

OTHER PUBLICATIONS

PCT Search Report and Written Opinion for PCT Application No. PCT/US2013/020208, Sep. 30, 2013, 12 pages.

(Continued)

*Primary Examiner* — Amy Cohen Johnson
*Assistant Examiner* — Vladimir Imas
(74) *Attorney, Agent, or Firm* — Maine Cernota & Rardin

(57) ABSTRACT

A novel connector pair suppresses arcing during connection and disconnection. In one general aspect of the invention, first and second insulating barriers are configured to extend beyond corresponding first and second contacts, the barriers being arranged to cover a leading end of at least one of the contacts, and to engage with each other when the contacts are separated by a small gap, thereby closing off substantially all through-air arcing paths between them. In another general aspect of the invention, at least one electrical contact in a connector pair is a bimetal contact having a transitional segment made from high resistivity metal. The transitional segment is configured to make first and last contact during the initial phases of mating and un-mating, thereby increasing electrical resistance and significantly lowering the electrical current and the energy available for electrical arcing.

18 Claims, 7 Drawing Sheets

(56) References Cited

U.S. PATENT DOCUMENTS

| | | | | | |
|---|---|---|---|---|---|
| 4,387,947 | A * | 6/1983 | Lostumo et al. | 439/314 |
| 4,713,018 | A * | 12/1987 | Sutton | 439/185 |
| 4,863,392 | A * | 9/1989 | Borgstrom et al. | 439/185 |
| 4,986,764 | A * | 1/1991 | Eaby et al. | 439/275 |
| 5,041,027 | A * | 8/1991 | Lien | 439/796 |
| 5,146,678 | A * | 9/1992 | Lien | 29/857 |
| 5,213,517 | A * | 5/1993 | Kerek et al. | 439/187 |
| 5,316,492 | A * | 5/1994 | Schaareman | 439/206 |
| 6,097,789 | A * | 8/2000 | Mueller | 378/130 |
| 6,247,943 | B1 * | 6/2001 | Moga et al. | 439/125 |
| 6,485,318 | B1 * | 11/2002 | Schoepf | 439/187 |
| 6,537,092 | B2 * | 3/2003 | Hirai et al. | 439/181 |
| 6,555,751 | B1 * | 4/2003 | Umeki et al. | 174/75 R |
| 6,753,624 | B2 * | 6/2004 | Miwa | 307/112 |
| 7,163,753 | B2 * | 1/2007 | Ota et al. | 428/647 |
| 7,670,162 | B2 * | 3/2010 | Hughes | 439/187 |
| 7,723,611 | B2 * | 5/2010 | Stagi et al. | 174/15.1 |
| 7,731,514 | B2 * | 6/2010 | Hughes et al. | 439/181 |
| 7,905,735 | B2 * | 3/2011 | Hughes | 439/181 |
| 7,946,871 | B1 | 5/2011 | Yu et al. | |
| 7,950,940 | B2 * | 5/2011 | Hughes | 439/181 |
| 7,963,782 | B2 * | 6/2011 | Hughes | 439/181 |
| 8,096,814 | B2 * | 1/2012 | Schell et al. | 439/79 |
| 8,328,569 | B2 * | 12/2012 | Roscizewski et al. | 439/187 |
| 2002/0064986 | A1 | 5/2002 | Hirai et al. | |
| 2003/0194893 | A1 | 10/2003 | Ota et al. | |

OTHER PUBLICATIONS

Anderson Power Products, Saf-D-Grid model 2002G Electrical Connector, dated Jul. 27, 2009, 2 pages.

* cited by examiner

ELECTRICAL CONNECTOR WITH ANTI-ARCING FEATURE

FIELD OF THE INVENTION

The invention relates to electrical connectors, and more particularly, to an electrical connector that suppresses arcing if connected or disconnected while current is flowing.

BACKGROUND OF THE INVENTION

Electrical connectors generally should not be connected or disconnected while the electrical load is turned on. Electrical arcing between the separated contacts of a live electrical connector present a hazard of fire and of burns to the user, and any such arcing tends to reduce the useful life of the connector.

Nevertheless, due to the fallibility of human nature, it remains true that electrical connectors may at times be inadvertently connected or disconnected while the electrical load is turned on. When the electricity is alternating current, arcing is less of a problem, because the sinusoidal nature of the alternating current will cause the voltage to be zero at some point during the electrical contact separation, and any arcing will tend to self-extinguish. However, when the electricity is direct current, the voltage is constant and never zero, and electrical arcing between the separating contacts will be maintained over a substantial range of contact separations, creating a burn hazard for the user and reducing the useful life of the connector.

One approach is to provide a separate, shorter set of contacts within the connector, and configure the connector so that the shorter contacts are engaged after and disengaged before the primary electrical connections. The lack of current across the shorter connection is then used to trigger a separate switching device placed in the primary electrical circuit that shuts off the current in the circuit before the separation of the primary electrical connections. However, adding an additional contact and switching device increases both the bulk and the cost of the system.

Another approach is to include an insulating barrier that covers the leading end of one of the electrical contacts and blocks the direct through-air path between the contacts as the connectors are mated and un-mated. However, in this approach arcing can still occur through an indirect path that by-passes the insulating barrier.

What is needed, therefore, is an electrical connector that suppresses electrical arcing between separated contacts during connection and disconnection, without adding an additional connection and switching device.

SUMMARY OF THE INVENTION

A novel connector pair suppresses electrical arcing between separated contacts during mating and un-mating of the connectors, without including an additional connection or switching device. One general aspect of the invention includes an insulating barrier that suppresses arcing between separated contacts during connection and disconnection of the electrical contacts. The insulation barrier of the present invention thereby protects users from electrical burns and extends the useful life of the connector.

The insulating barrier includes both a male and a female barrier, at least one of which is configured so that it extends beyond at least one of the contacts and covers the leading edge of the contact. The male and female barriers engage with each other when the contacts are separated, thereby closing off all through-air paths between the contacts and suppressing arcing.

In embodiments, arcing between separated contacts is further suppressed by constructing the leading edge of at least one of the electrical contacts from a metal having low electrical conductivity, so that the electrical resistance of the connection is significantly increased immediately before the contacts are separated, thereby lowering the electrical current and the energy available for electrical arcing, without adding an additional connection or any special switching circuitry.

In another general aspect of the present invention, at least one of the electrical contacts in at least one of the connectors is a bi-metal contact having a metallic composition that is configured to create within the contact an operating segment that has low resistance and a transitional segment that has high resistance, where the transitional segment makes exclusive initial and final contact during mating and un-mating of the connectors, and the operating segment conducts current when the connectors are fully mated. In embodiments, the transitional segment is located at the leading end of the electrical contact.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1A:
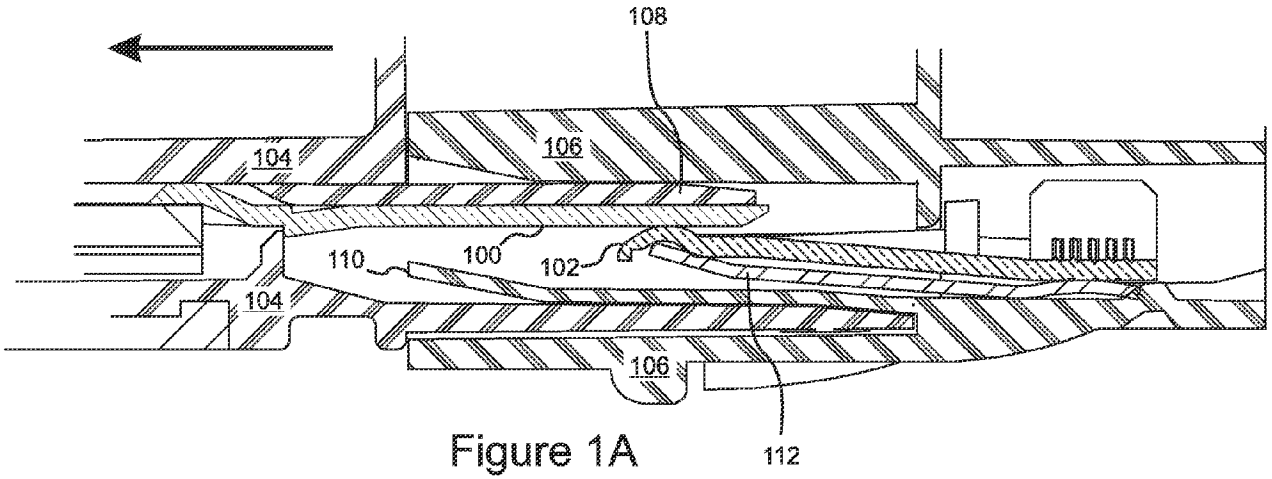
Figure 1A Prior Art
FIG. 1A is a partial cross-sectional diagram of a prior art male and female connector pair in a connected configuration.

With reference to FIG. 1A, a typical male and female connector pair of the prior art includes a male contact 100 and a female contact 102. One of the contacts (here the female contact 102) is flexible and is placed under tension by a spring 112 so that a shaped region of the contact 102 will ride over the leading end of the male contact 100 and press against a connecting surface of the male contact 100 when the connectors are mated. Insulated housings 104, 106 surround the male and female contacts, and shield the contacts from environmental hazards, as well as providing some protection to a user in case arcing occurs when the user is handling the connector pair. In the prior art example of FIG. 1A, additional insulating structures 108, 110 are provided proximal to the outer faces of the contacts 100, 102 to support the contacts 100, 102, and to provide receiving channels for the two insulating housings 104, 106 to mate. A spring 112 is also included to provide a pressing tension between the flexible female contact 102 and the fixed male electrical contact 100.

Figure 1B:
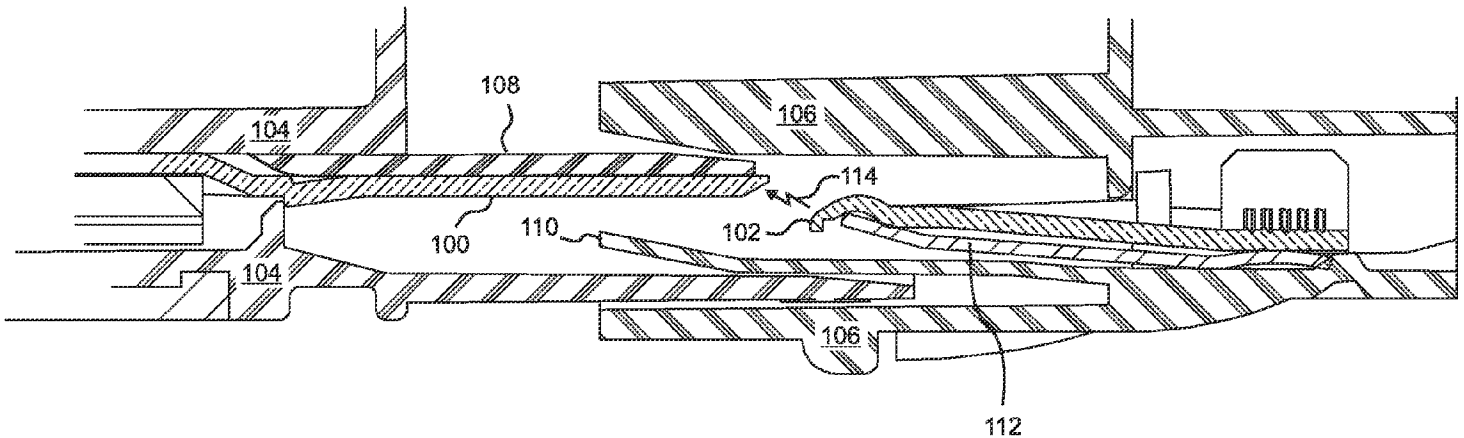
Figure 1B Prior Art
FIG. 1B is a partial cross-sectional diagram of the prior art connector pair of FIG. 1A showing arcing during disconnection.

FIG. 1B shows the connector pair of FIG. 1A having been partially disconnected while a voltage is still being applied. The leading ends of the two contacts 100, 102 are separated by a short gap, and through-air electrical arcing 114 is taking place between them.

Figure 2A:
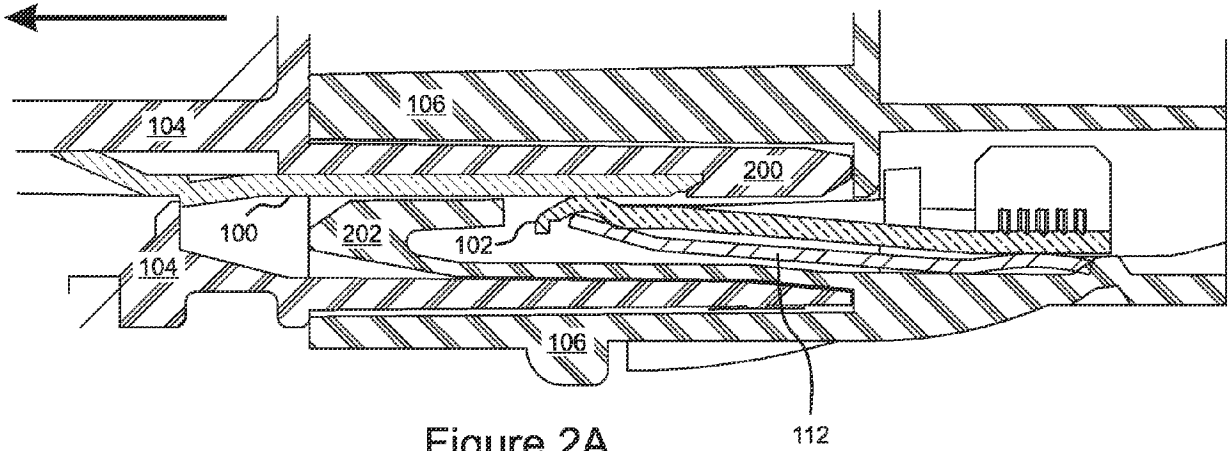
FIG. 2A is a partial cross-sectional diagram of a male and female connector pair in a connected configuration according to an embodiment of the present invention.

FIG. 2A is a partial cross-sectional illustration of an embodiment of the present invention, shown in a connected configuration. The embodiment is similar to the prior art design of FIG. 1A, except that the insulating support structures 108, 110 have been replaced by insulating barrier structures 200, 202. The male insulating barrier structure 200 extends beyond the male contact 100, and covers the leading end of the male contact 100. The female insulating barrier 202 extends beyond the female contact 102. In this embodiment, the female barrier 202 is in front of the leading end of the female contact. In similar embodiments it covers or nearly covers the end of the female contact.

Figure 2B:
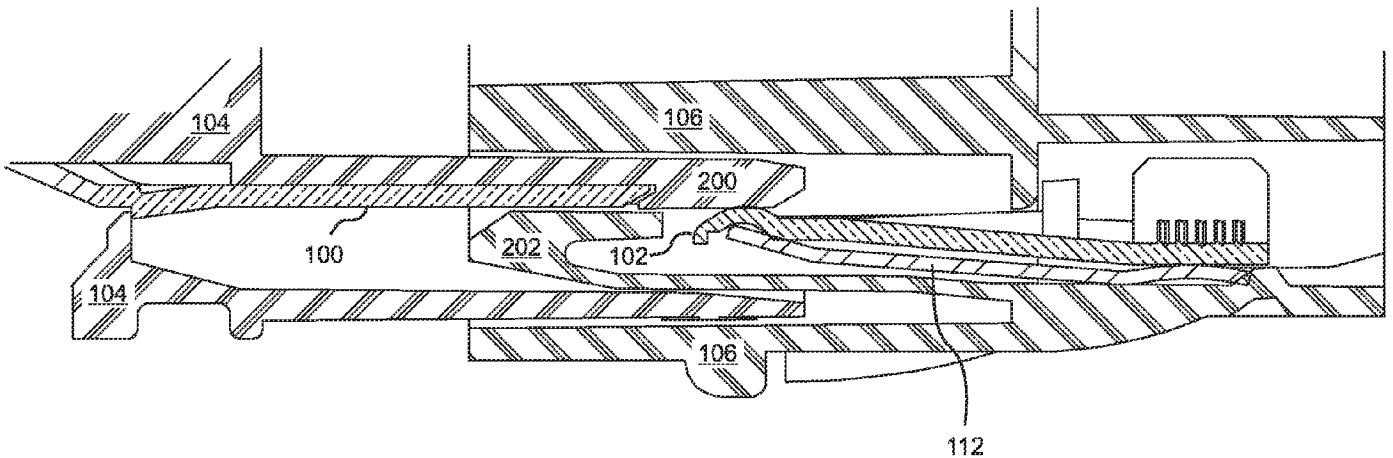
FIG. 2B is a partial cross-sectional diagram of the connector pair of FIG. 2A, showing suppression of arcing by the insulating barrier during disconnection.

FIG. 2B is a partial cross-sectional illustration of the embodiment of FIG. 2A shown in a partially disconnected configuration. Although the ends of the two contacts 100, 102 are not separated by a large distance, the male insulating barrier 200 is very near to or physically in contact with the femail insulating barrier 202, thereby blocking substantially all through-air arcing paths between the contacts 100, 102. Some embodiments include a spring or other tensioning mechanism that presses the male and female insulating barriers against each other when the connectors are partially disconnected.

Figure 3A:
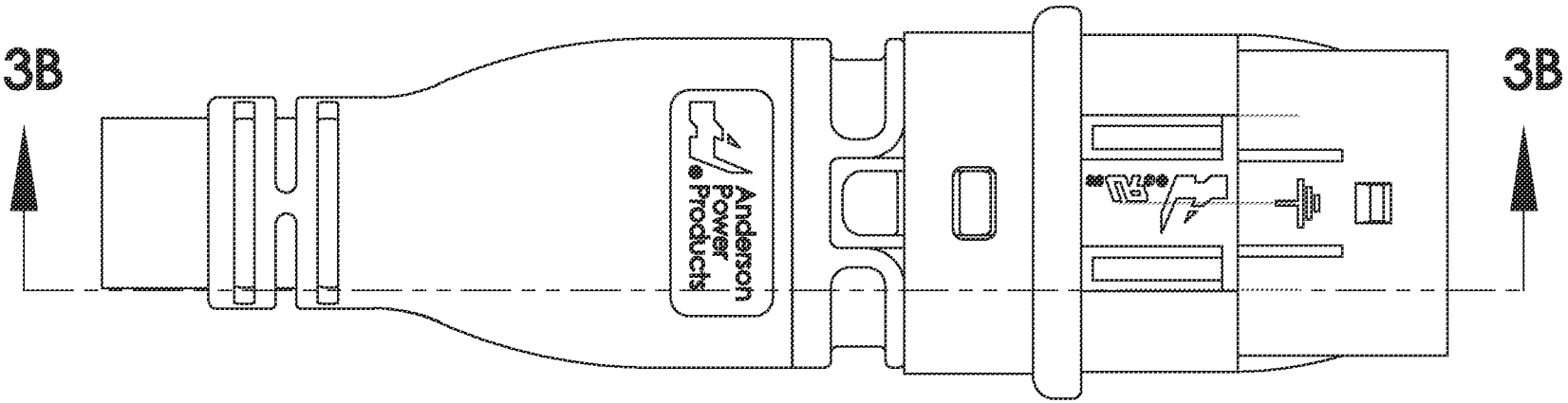
FIG. 3A is a top view of a male and female connector pair shown in a connected configuration according to an embodiment of the present invention.
Figure 3B:
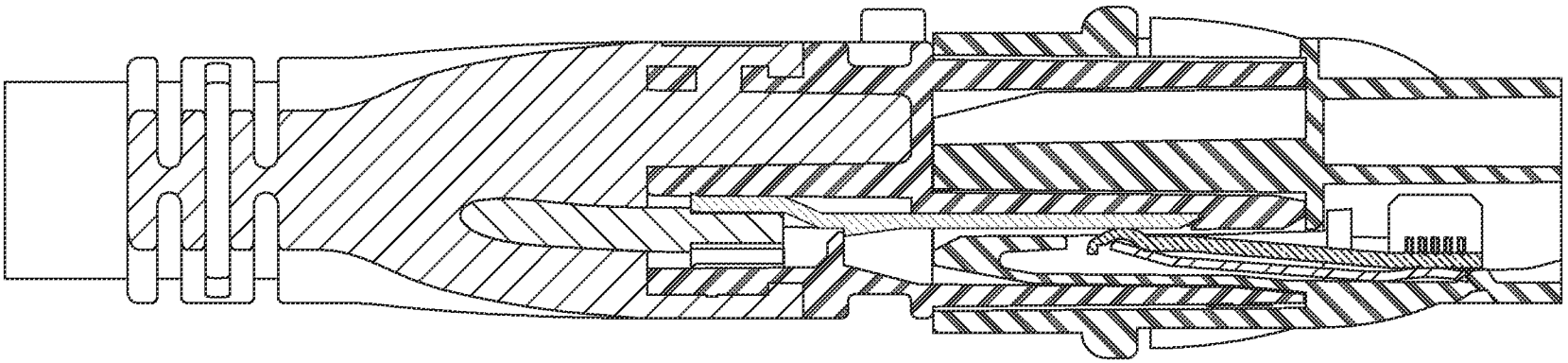
FIG. 3B is a cross-sectional side view of the connector pair of FIG. 3A.
Figure 4A:
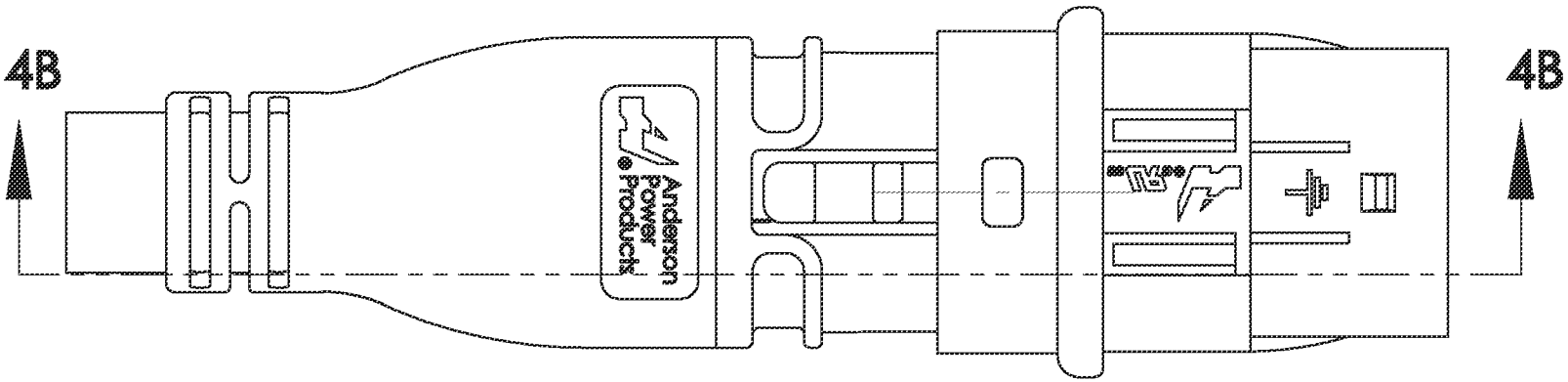
FIG. 4A is a top view of the male and female connector pair of FIG. 3A shown in a partially disconnected configuration.
Figure 4B:
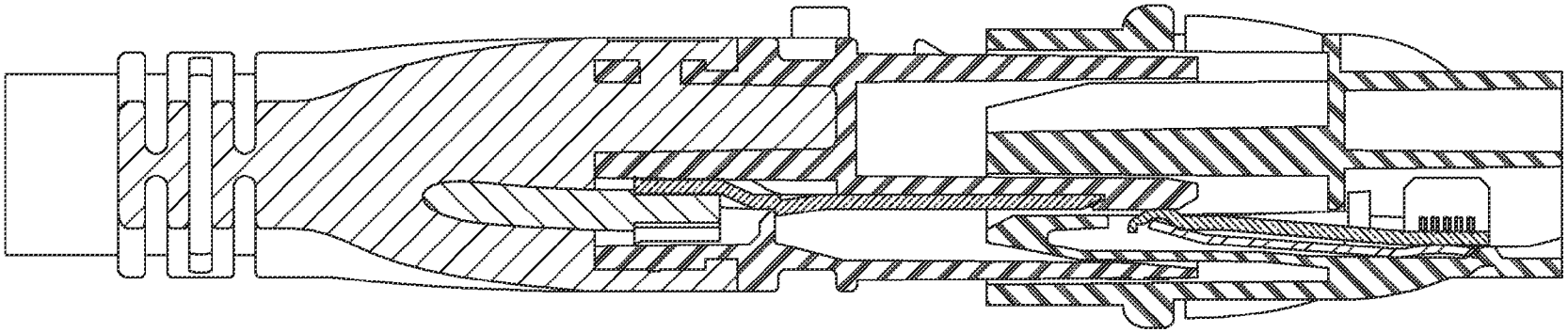
FIG. 4B is a cross-sectional side view of the connector pair of FIG. 4A.

FIG. 3A is a top view of the complete connector pair of which FIGS. 2A and 2B are partial cross sections, shown in a connected configuration. FIG. 3B is a cross-sectional side view of the complete connector of FIG. 3A. FIG. 4A is a top view of the complete connector pair of which FIGS. 2A and 2B are partial cross sections, shown in a partially disconnected configuration. FIG. 4B is a cross-sectional side view of the complete connector of FIG. 4A.

Figure 5A:
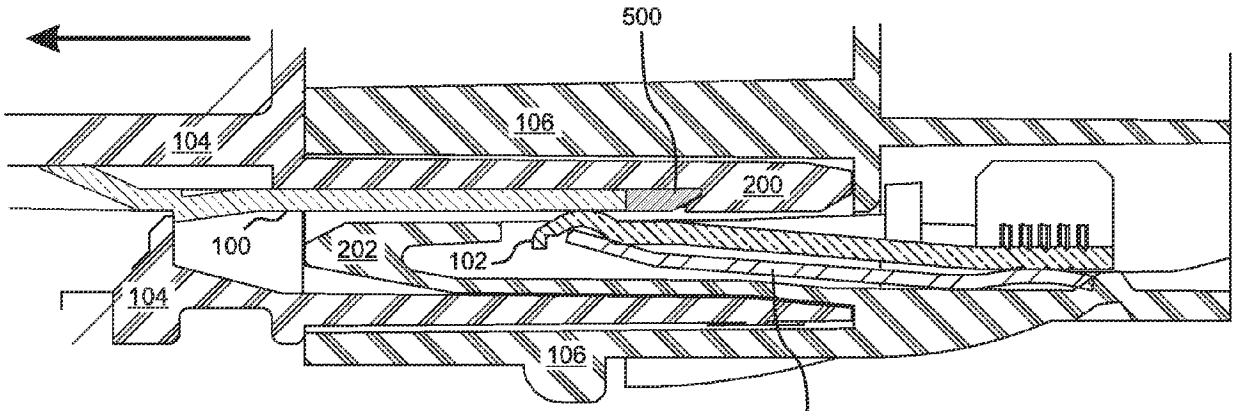
FIG. 5A is a partial cross-sectional side view of a connector pair similar to FIG. 2A, but including a contact having a leading segment made from a high resistance metal.
Figure 5B:
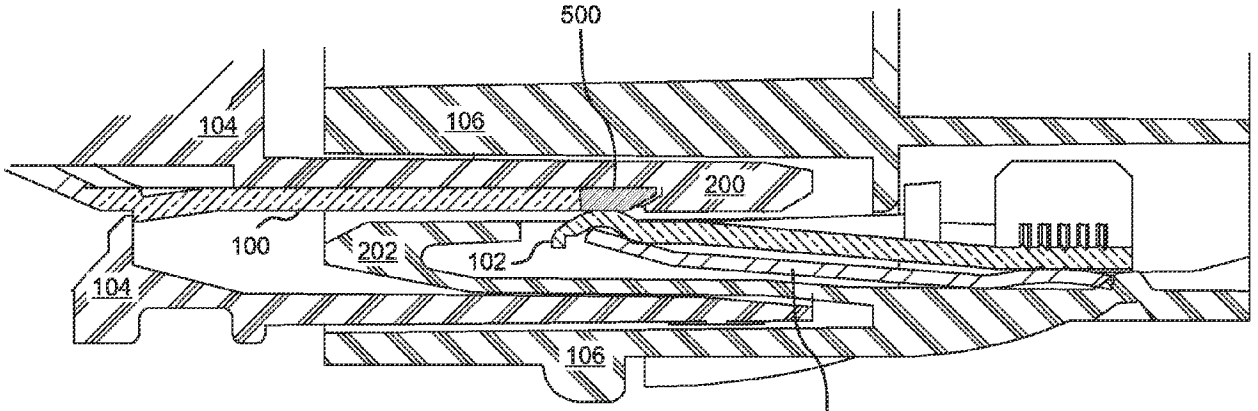
FIG. 5B is a cross-sectional side view of the connector pair of FIG. 5A, shown in a partially disconnected configuration.

With reference to FIGS. 5A and 5B, the suppression of arcing of the present invention is enhanced in some embodiments by manufacturing the leading end of at least one of the contacts 100 from a metal such as nickel-chrome or stainless steel that has a high electrical resistance 500. FIG. 5A is a partial cross-sectional side view of an embodiment similar to FIG. 2A, except that the leading end 500 of the male contact 100 is made from high resistance metal. The figure shows the connector in a connected configuration, where the female contact 102 physically engages with a part of the male contact 100 that is low resistance, for example copper.

FIG. 5B is a cross-sectional view of the embodiment of FIG. 5A shown in a partially disconnected configuration, where the female contact 102 is engaged with the high resistance end 500 of the male contact 100. It can be seen from the figure that during disengagement, the end of the female contact 102 slides from the low resistance portion of the male contact 100 onto the high resistance portion 500 of the male contact 100, and then onto the male insulating barrier 202 which blocks any tendency of the current to arc from the female contact 102 to the end 500 of the male contact 100. The resistance of the circuit is thereby increased during disconnection in two steps, rather than transitioning suddenly from low resistance to near-infinite resistance.

In another general aspect of the present invention, the insulating barriers 200, 202 are omitted, and arcing is suppressed primarily by manufacturing the leading end of at least one of the contacts 100 from a metal such as nickel-chrome or stainless steel that has a high electrical resistance 500.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. An electrical connector pair, comprising:

a first connector having a first insulating housing;

a first electrical contact supported within the first insulating housing, the first electrical contact having a connecting surface that is substantially parallel with a longitudinal axis of the insulating housing and terminates in a leading end of the first electrical contact;

a second connector having a second insulating housing;

a second electrical contact supported within the second insulating housing, the second electrical contact being configured to laterally engage with the connecting surface of the first electrical contact when the first connector is mated with the second connector;

a first insulating barrier within the first connector extending beyond and covering the leading end of the first electrical contact; and a second insulating barrier extending beyond the second electrical contact within the second connector, the second insulating barrier being configured so as to be in close proximity with the first insulating barrier when the first and second connectors are partially disconnected and the first and second electrical contacts are separated by a short distance, thereby blocking substantially all through-air arcing paths between the first and second electrical contacts.

2. The connector pair of claim 1, further comprising a contact tensioning mechanism that presses the second electrical contact against the engaging surface of the first electrical contact when the first and second connectors are connected.

3. The connector pair of claim 2, wherein the contact tensioning mechanism includes a spring.

4. The connector pair of claim 1, further comprising a barrier tensioning mechanism that presses the first and second insulating barriers against each other when the first and second connectors are partially disconnected and the first and second electrical contacts are separated by a short distance.

5. The connector pair of claim 1, wherein the first electrical contact includes a high resistance section at the leading end, the high resistance section being configured to initially engage with the second electrical contact when the first and second connectors are mated, and to make final engagement with the second electrical contact when the first and second electrical connectors unmated.

6. The connector pair of claim 5, wherein the first electrical contact is a bi-metal contact, and the high resistance section is made of a metal having a higher resistance than other regions of the first electrical contact.

7. The connector pair of claim 1, wherein at least one of the first and second electrical contacts includes a terminal for crimping to a wire.

8. The connector pair of claim 1, wherein at least one of the first and second electrical contacts includes a terminal for soldering to a printed circuit or wiring board.

9. The connector pair of claim 1, wherein at least one of the first and second electrical contacts includes a terminal for soldering a wire or and electrical component to the contact.

10. The connector pair of claim 1, wherein at least one of the first and second electrical contacts includes a terminal using insulation displacement for attaching a wire to the contact.

11. The connector pair of claim 1, wherein at least one of the first and second electrical contacts includes a screw terminal for attaching a wire to the contact.

12. The connector pair of claim 1, wherein at least one of the first or second electrical contact is configured with a terminal using a spring mechanism for attaching at least one wire to the contact.

13. An electrical connector pair, comprising:

a first connector having a first insulating housing;

a first electrical contact supported within the first insulating housing;

a second connector having a second insulating housing; and a second electrical contact supported within the second insulating housing, the second electrical contact being a bi-metal contact having an operating segment through which current flows when the connectors are fully mated, and a transitional segment through which electrical current flows exclusively during an initial phase of mating and a final stage of un-mating of the connectors, the transitional segment having a metallic composition, the transitional segment being higher in resistivity than the operating segment.

14. The connector pair of claim 13, wherein the transitional segment is at a leading end of one of the electrical contacts.

15. The connector pair of claim 13, further comprising a contact tensioning mechanism that presses one of the electrical contacts against the other electrical contact when the first and second connectors are connected.

16. The connector pair of claim 15, wherein the contact tensioning mechanism includes a spring.

17. The connector pair of claim 13, further comprising:

a first insulating barrier extending beyond the first electrical contact within the first connector; and a second insulating barrier extending beyond and covering the leading end of the second electrical contact, the second insulating barrier being configured so as to be in close proximity with the first insulating barrier when the first and second connectors are partially disconnected and the first and second electrical contacts are separated by a short distance, thereby blocking substantially all through-air arcing paths between the first and second electrical connectors.

18. The connector pair of claim 17, further comprising a barrier tensioning mechanism that presses the first and second insulating barriers against each other when the first and second connectors are partially disconnected and the first and second electrical contacts are separated by a short distance.

* * * * *